US010799746B2

(12) United States Patent
Andon

(10) Patent No.: US 10,799,746 B2
(45) Date of Patent: Oct. 13, 2020

(54) TRAMPOLINES

(71) Applicant: Vuly IP Holdings No. 2 Pty Ltd, Wakerley, Qld (AU)

(72) Inventor: Joe Andon, Wakerley (AU)

( * ) Notice: Subject to any disclaimer, the term of this patent is extended or adjusted under 35 U.S.C. 154(b) by 53 days.

(21) Appl. No.: 15/778,628

(22) PCT Filed: Nov. 24, 2016

(86) PCT No.: PCT/AU2016/051152
§ 371 (c)(1),
(2) Date: May 24, 2018

(87) PCT Pub. No.: WO2017/088023
PCT Pub. Date: Jun. 1, 2017

(65) Prior Publication Data

US 2018/0326244 A1 Nov. 15, 2018

(30) Foreign Application Priority Data

Nov. 24, 2015 (AU) ..... 2015905187
Apr. 1, 2016 (AU) ..... 2016901210

(51) Int. Cl.
*A63B 21/02* (2006.01)
*A63B 5/11* (2006.01)

(52) U.S. Cl.
CPC ..... *A63B 21/026* (2013.01); *A63B 5/11* (2013.01)

(58) Field of Classification Search
CPC ..... A63B 21/026; A63B 5/11; A63B 5/16; A63B 5/12; A63B 5/08
See application file for complete search history.

(56) References Cited

U.S. PATENT DOCUMENTS

2002/0098948 A1* 7/2002 Yoon ..... A63B 5/11 482/27
2017/0108152 A1* 4/2017 Hsiang ..... F16L 41/021

FOREIGN PATENT DOCUMENTS

WO WO-2012167313 A1 * 12/2012 ..... A63B 5/11
WO WO-2015100466 A1 * 12/2013 ..... A63B 5/11
WO WO-2016000036 A1 * 6/2014 ..... A63B 5/11
WO WO-2016004462 A1 * 7/2015 ..... A63B 5/11

* cited by examiner

*Primary Examiner* — Loan B Jimenez
*Assistant Examiner* — Andrew M Kobylarz
(74) *Attorney, Agent, or Firm* — Shaver & Swanson, LLP; Scott D. Swanson

(57) ABSTRACT

A trampoline including: a frame including a plurality of frame segments/units connected together, each segment including lower and upper frame members secured together in spaced apart relationship for assembly with other like segments/units; a plurality of spaced apart flexible and resilient plates connected to the lower frame member of each segment/unit and extending upwards therefrom; a jumping mat extending between said plates and being operatively connected at or adjacent its periphery thereto, said plates engaging the upper frame member of each segment/unit respectively above the lower frame member of the respective segment and being arranged for movement inwards and outwards towards the opposite side of said mat and/or up and down in response to a user jumping on said mat, the plates having an upper portion preformed to have a bend in one direction and a lower portion preformed to have a bend in the opposite direction.

18 Claims, 9 Drawing Sheets

TRAMPOLINES

This invention relates to trampolines. The invention has particular application to recreational trampolines but it may have application to sporting trampolines as well.

For many years recreational trampolines have typically included a tubular steel frame which is supported on spaced apart legs with a flexible jumping mat secured to the frame by a large number of spaced apart extension springs which extend and contract as a person jumps on the mat in order to give "bounce". The springs are usually connected to the tubular steel frame at one end via radial slots provided therein and to the mat via hooks or the like at the other end. Although trampolines can be made in many shapes, circular is probably the most popular in which case the frame is generally constructed of arcuate segments of round tube which are joined together in a spigot and socket arrangement with the end portion of one segment sliding into the end portion of the adjacent segment.

The space between the jumping mat and the frame poses some risk of injury for users getting onto and off the mat and when jumping on the mat too close to the edge. A padded safety barrier is often provided about the mat and covering the springs and the spaces therebetween. The padding is typically tied to the mat and/or the frame by ribbon ties or the like. Trampolines may also include a safety barrier (or "net") extending about and upward from the mat frame and attached to posts upstanding therefrom to prevent users from falling off the trampoline.

Other forms of trampolines known as "soft edged trampolines" which do not require a frame about the edge of the jumping mat and do not use extension springs to support the mat have been developed. In such trampolines, the mat is typically supported on a large number of circumferentially spaced rods or leaf springs which extend upwards, outwards or inwards, and sometimes circumferentially around the mat from a frame under or below the mat and are connected to the edge of the mat at their upper ends. The rods or leaf springs are flexible and resilient so as to bend downwards and laterally as a person's weight comes onto the mat during jumping and to return to the original position as the weight comes off the mat. Trampolines which have circumferentially extending rods have a back and forth twisting motion of the mat in use, giving a different performance feel to users. Trampolines such as are described in international patent application No PCT/AU2012/000651 (the first PCT application) utilize leaf springs extending upwards and inwards or outwards from a frame resting on the ground where they connect to the jumping mat and hold it in tension and do not require tension springs. Another form of trampoline not requiring tension springs is described in international patent application No PCT/AU2013/001407 (the second PCT application).

The trampolines described in the first PCT application incorporate a bottom frame from which a plurality of spaced apart flexible and resilient plates, preferably leaf springs, extend upwards and terminate in free upper ends to which a jumping mat is connected, the plates being arranged for movement inwards and outwards towards the opposite side of the mat in response to a person jumping on the mat. The second PCT application relates to an improved version of the trampoline described in the first PCT application in which an intermediate rail is provided between the bottom rail to which the leaf springs are connected at their lower ends and the mat which is connected to the leaf springs at their upper ends.

The trampolines described and illustrated in the first and second PCT applications have been found to be very safe with very good performance characteristics and have a relatively long life. However, the construction of such trampolines is generally heavy and costly.

The present invention is aimed at providing an improved trampoline which is lighter and less expensive while still being reliable and efficient in use. The invention is also aimed at providing a trampoline which can be efficiently manufactured. The invention is also aimed at providing a trampoline which maintains the traditional feel of a trampoline more satisfactorily than presently known soft edged trampolines.

With the foregoing in view, the invention in one aspect resides broadly in a trampoline including:

a frame including a plurality of frame segments or units connected together, each segment including lower and upper frame members secured together in spaced apart relationship for assembly with other like segments or units;

a plurality of spaced apart flexible and resilient plates connected to the lower frame member of each segment or unit and extending upwards therefrom;

a jumping mat extending between said spaced apart flexible and resilient plates and being operatively connected at or adjacent its periphery thereto, said plates engaging the upper frame member of each segment or unit respectively above the lower frame member of the respective segment and being arranged for movement inwards and outwards towards the opposite side of said mat and/or up and down in response to a user jumping on said mat.

In another aspect, the invention resides broadly in a trampoline including:

a frame adapted to rest on the ground or be mounted on a plurality of spaced apart legs, said frame including a bottom frame member defining a substantially enclosed space;

a plurality of spaced apart flexible and resilient plates extending upwards from said frame, each of said flexible and resilient plates having an upper end and a lower end and being connected to said frame at or adjacent their respective lower ends against relative movement between each flexible and resilient plate and said frame; and a jumping mat extending over said substantially enclosed space above said frame between said opposed flexible and resilient plates and being operatively connected at or adjacent its periphery to said flexible and resilient plates at or adjacent their upper ends for movement with said flexible and resilient plates upon a person jumping on said mat; and wherein each flexible and resilient plate has a lower portion curved in one direction and an upper portion curved in the opposite direction.

In another aspect, the present invention resides broadly in a preformed leaf spring for a trampoline, the leaf spring comprising a flexible and resilient plate having a lower portion curved in one direction and an upper portion curved in the opposite direction, connection means at or near the upper end of the upper portion for connecting to a jumping mat of a trampoline and the lower end of the lower portion being adapted to engage with a slot in a bottom member of a frame for the trampoline.

Preferably, the plates are preformed to provide the upper and lower portions. Preferably, the frame includes a plurality of frame segments or units connected together, each segment including lower and upper frame members secured together in spaced apart relationship for assembly with other like segments or units. In such form, the lower and upper frame members are permanently secured together by spacer members welded thereto such that the segments or units can be sold in a kit and easily assembled by a purchaser such as a home handyman. Advantageously, the present invention allows a home handyman to assemble a trampoline because one important part of assembly, that is, the engagement of the plates in the lower frame member and the bearing of the plates against the upper frame member is made easy by having the two frame members permanently fixed together in the assembly kit.

Preferably, the spacing of the lower and upper frame members is such that the distance between the surface of the lower frame member where the leaf spring extends therefrom to the point of contact of the leaf spring with the outer face of the upper frame member is between about 100 mm and 250 mm and more preferably between about 100 mm and 200 mm and preferably about 140 mm.

Preferably, said spaced apart flexible and resilient plates are connected to said lower frame member by locating in spaced apart slots formed in said frame member, the slots being suitably sized to form a tight fit about the plates. In such form, it is preferred that retaining means be provided to retain the plates in the slots.

Preferably, the upper and lower frame members are secured together such that when fitted to each other to form a circumferential frame for supporting the mat via the plates, the diameter of the upper frame member is slightly smaller than that of the lower frame member. Similarly, in the case of a rectangular trampoline, the perimeter of the upper frame member would be slightly less than the perimeter of the lower frame member. Advantageously, where the plates are leaf springs with their lower ends fitted into slots provided in the upper face of the lower frame member, such arrangement results in the plates being substantially vertical between the upper and lower frame members or leaning inwards slightly.

Preferably, the trampoline includes legs arranged to support the frame above the ground or other foundation. In such form, it is preferred that the legs include connector means for connecting frame segments thereto. In a preferred form, it is preferred that the connector means be arranged to connect two frame segments thereto with one frame segment extending in one direction and one in the generally opposite direction so that the two segments form a continuous frame and so on with adjacent posts. In a preferred form the frame segments are formed from round tube and the connector means are spigots adapted to fit firmly in the hollows of the frame segments or sockets adapted to receive firmly therein the end portions of the frame segments.

In a particularly preferred form, the posts extend upwards beyond the mat to provide safety net support poles for supporting a safety net about the mat extending upward from the periphery thereof.

Advantageously, when the mat has been fitted, the upper frame members engage the plates against their respective inner faces allowing the plates to freely move against the outer face thereof so as to provide a fulcrum about which each plate may pivot at least to a small extent while at the same time preventing or at least substantially inhibiting lateral movement of the plates towards the opposite side of the mat at the region of engagement. In such form, the plates are not connected to the rail but rather are allowed to freely move thereagainst. However, in some forms of the invention, locating means may be provided to prevent sliding movement of each plate along the rail in either a circumferential direction around the mat or a longitudinal direction along the plate.

The second PCT application explains that engagement of the plate support means by each flexible and resilient plate in a free pivoting manner allows the plates to perform as a series of springs. It also explains that the plates can be selected to provide different performance characteristics.

Preferably, the mat is connected to the flexible and resilient plates adjacent their upper ends by connector assemblies incorporating a hook and a load bearing fitting mounted in a pocket formed in the mat adjacent its periphery. In such form, it is preferred that the hook be connected at one end to the mat via the load bearing fitting and to the plates at the other end via one or more hook openings formed in the plate adjacent its upper end.

The parts are preferably provided in a kit for assembly, but once assembled, the resilient plates are inserted into the apertures of the lower frame member orientated with the lower portion proceeding upward and outward substantially to the level of the upper frame member, and therefrom, the upper portion proceeding upward and inward to the edge of the jumping mat to which the upper ends are operatively connected. The curvature of the lower portion is preferably less in extent than the curvature of the upper portion. It is also preferred that the curvature of the upper portion of the resilient plates, when in a relaxed condition, that is, pre-assembled, have a larger radius of curvature than the lower portion, but when assembled, are strained to a curvature much the same as the curvature of the lower portion.

The provision of the double-curvature arrangement, coupled with the resilient plates being only a single plate, as opposed to multi-leaf springs arrangement, provides a lighter and less expensive arrangement, even though a larger number of resilient plates are required as compared to prior versions of the leaf-spring trampoline.

Preferably, the trampoline has a circular mat, but it will be appreciated that oval, square or rectangular trampolines may be provided, or other shapes. It is also preferred that the trampoline includes a safety net attached to the mat at or adjacent its periphery and extending upwards to connect to a plurality of support poles which are connected to the lower frame member and the upper frame member. The support poles and the base and upper frame members thus form a frame to which the resilient plates are mounted and to which the safety net is connected at connection points along its upper edge. The jumping mat is connected to the upper ends of the resilient plates directly or indirectly through a connection of the lower edge of the safety net to the resilient plates.

Preferably, the peripheral frame members each comprise a plurality of interconnected segments suitably sized for transport of the trampoline in knock-down form. Advantageously, such segments are connected in a manner so as to prevent relative rotational or pivoting movement therebetween. In that respect, it is preferred that the frame segments include keying means for keying them together against relative rotational movement.

Terms such as "horizontal", "vertical", "upwards", "downwards", "above", "below" and similar terms as used herein are for the purpose of describing the invention in its normal in-use orientation and are not intended to limit the invention to any particular orientation.

In order that the invention may be more readily understood and put into practice, reference will now be made to the accompanying drawings which illustrated a preferred embodiment of the invention and wherein.

Figure 1:
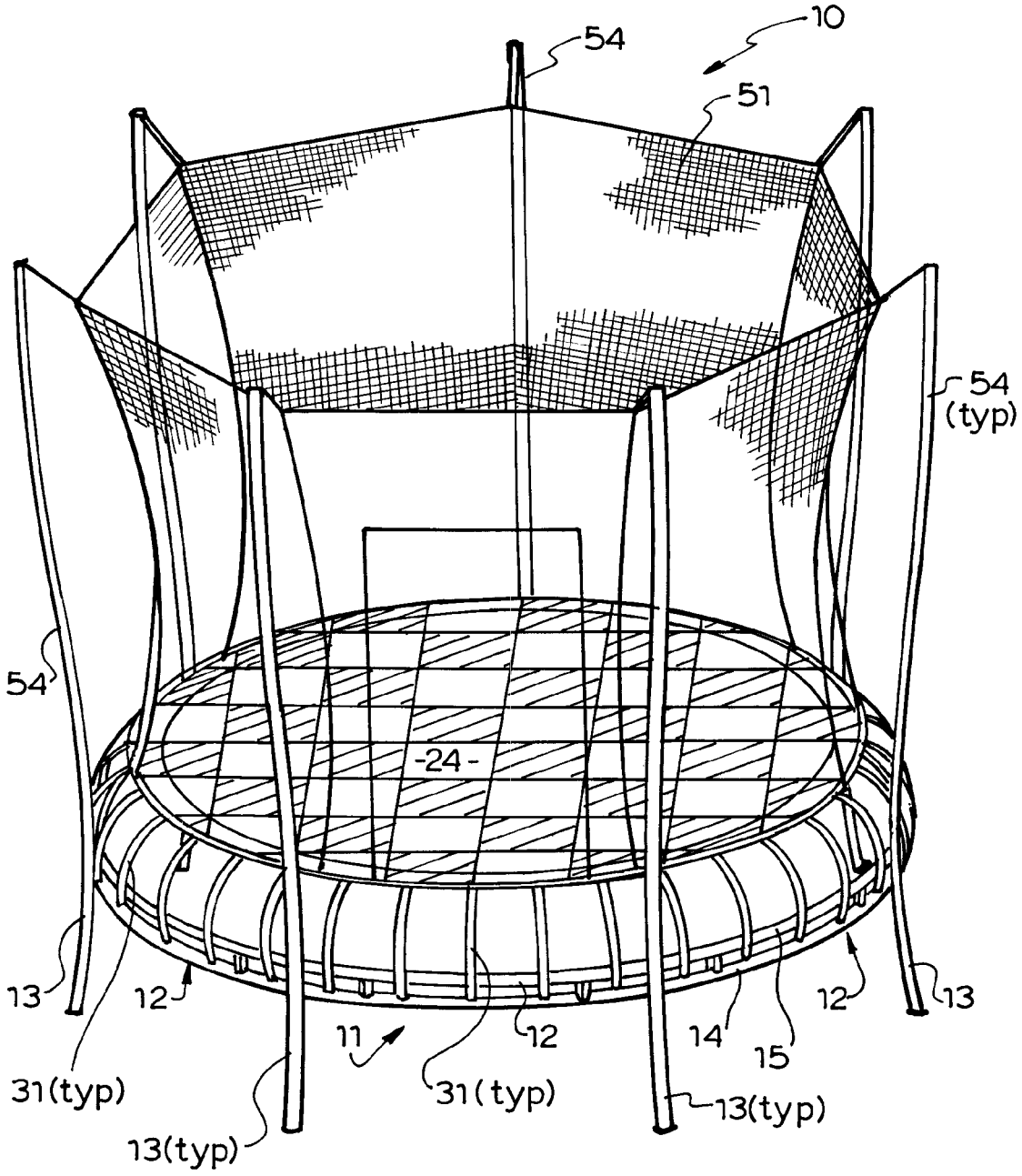
FIG. 1 is a pictorial representation of the trampoline from the front according to the invention resting on a floor with a safety enclosure fitted.
Figure 2:
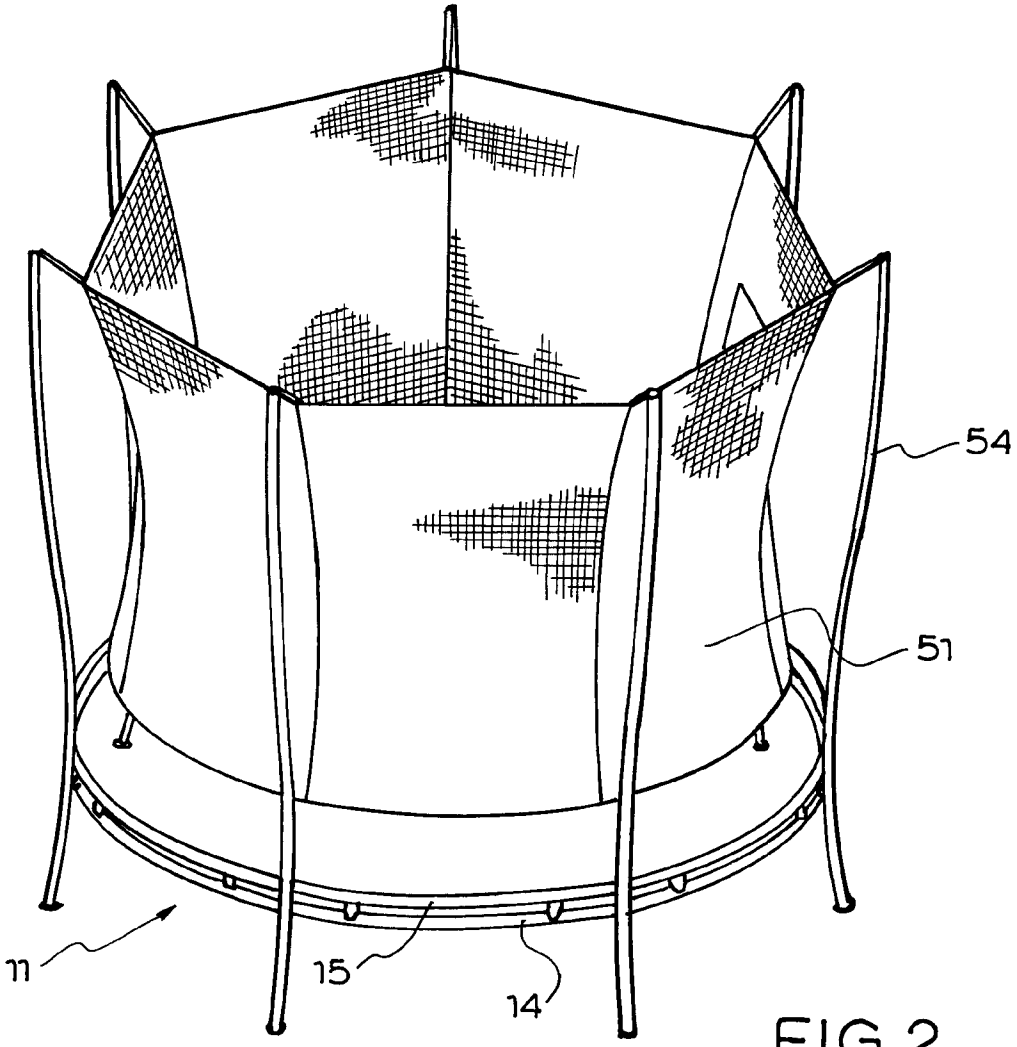
FIG. 2 is a schematic pictorial representation of the trampoline of FIG. 1 with some components removed for clarity.
Figure 3:
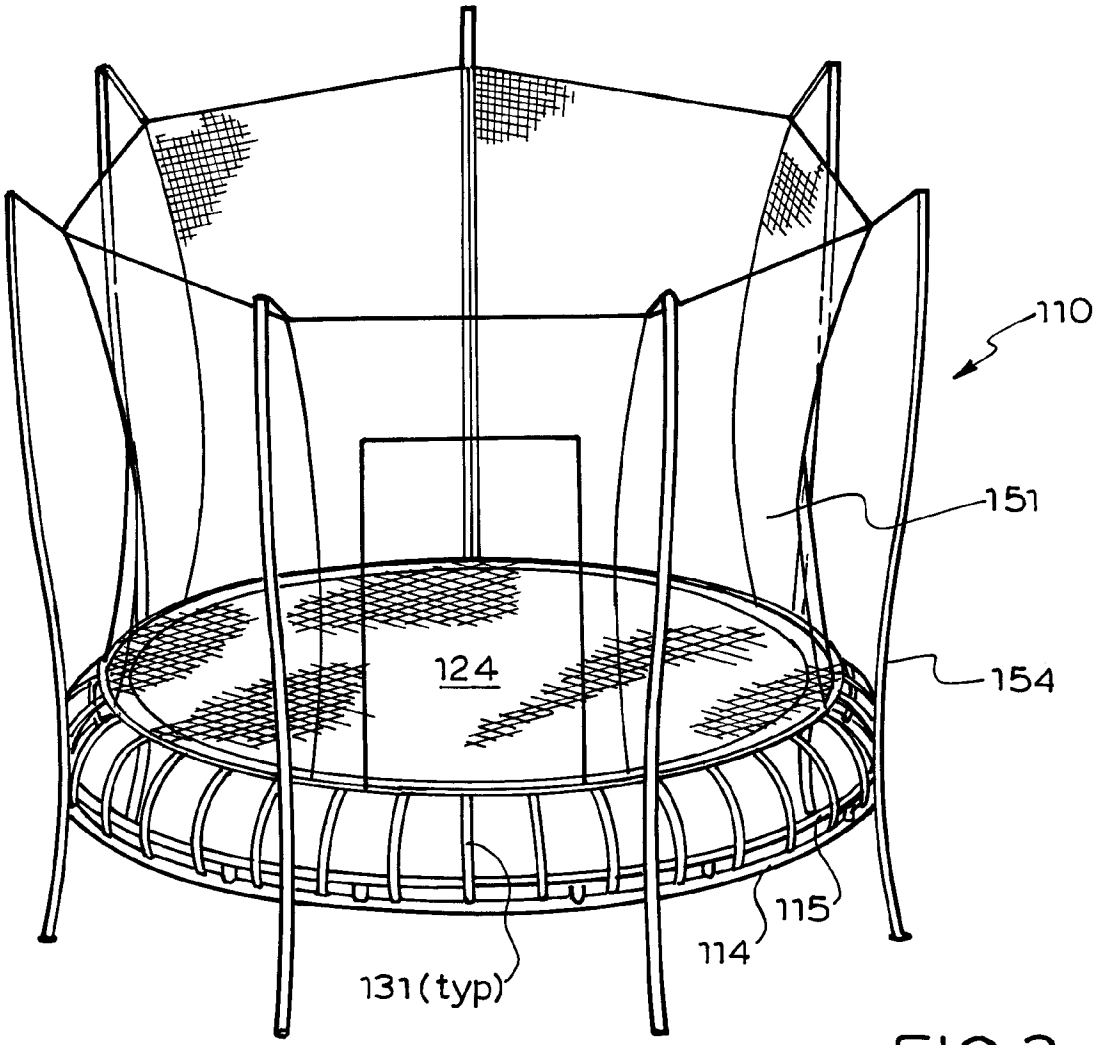
FIG. 3 is a pictorial representation of another trampoline from the front according to the invention.
Figure 4:
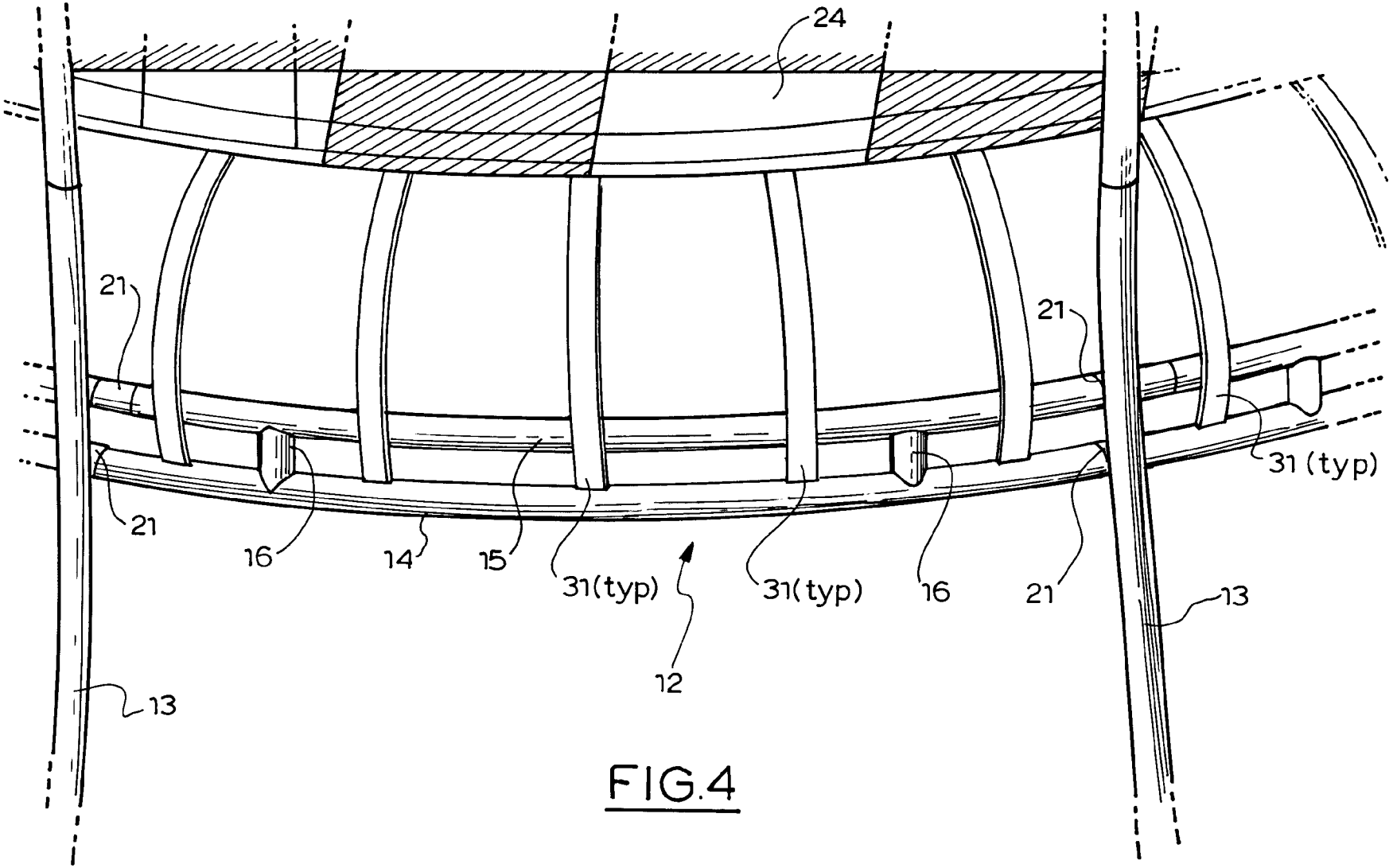
FIG. 4 is an enlarged pictorial representation of part of the trampoline of FIG. 1.
Figure 5:
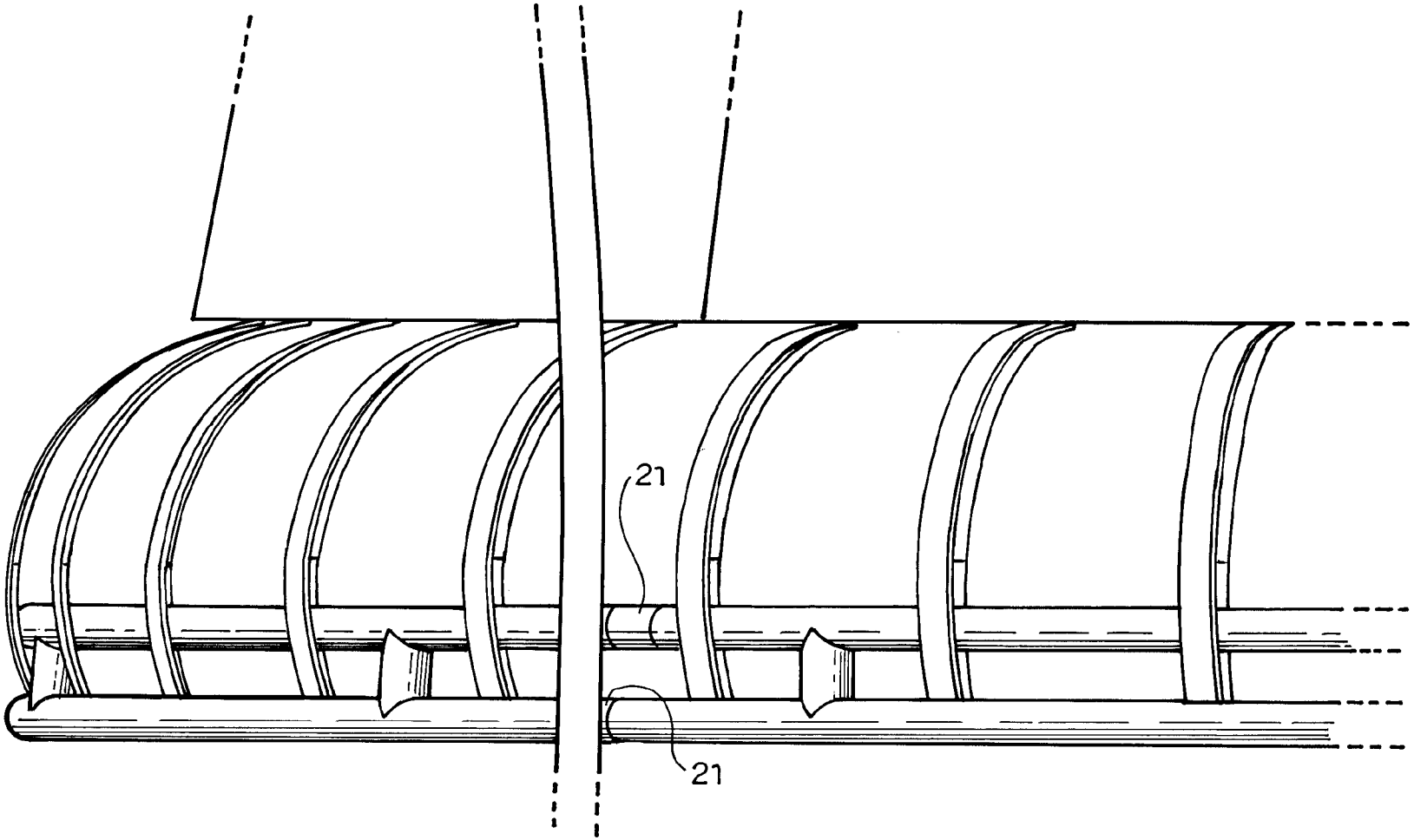
FIG. 5 is another enlarged pictorial representation of part of the trampoline of FIG. 1.
Figure 6:
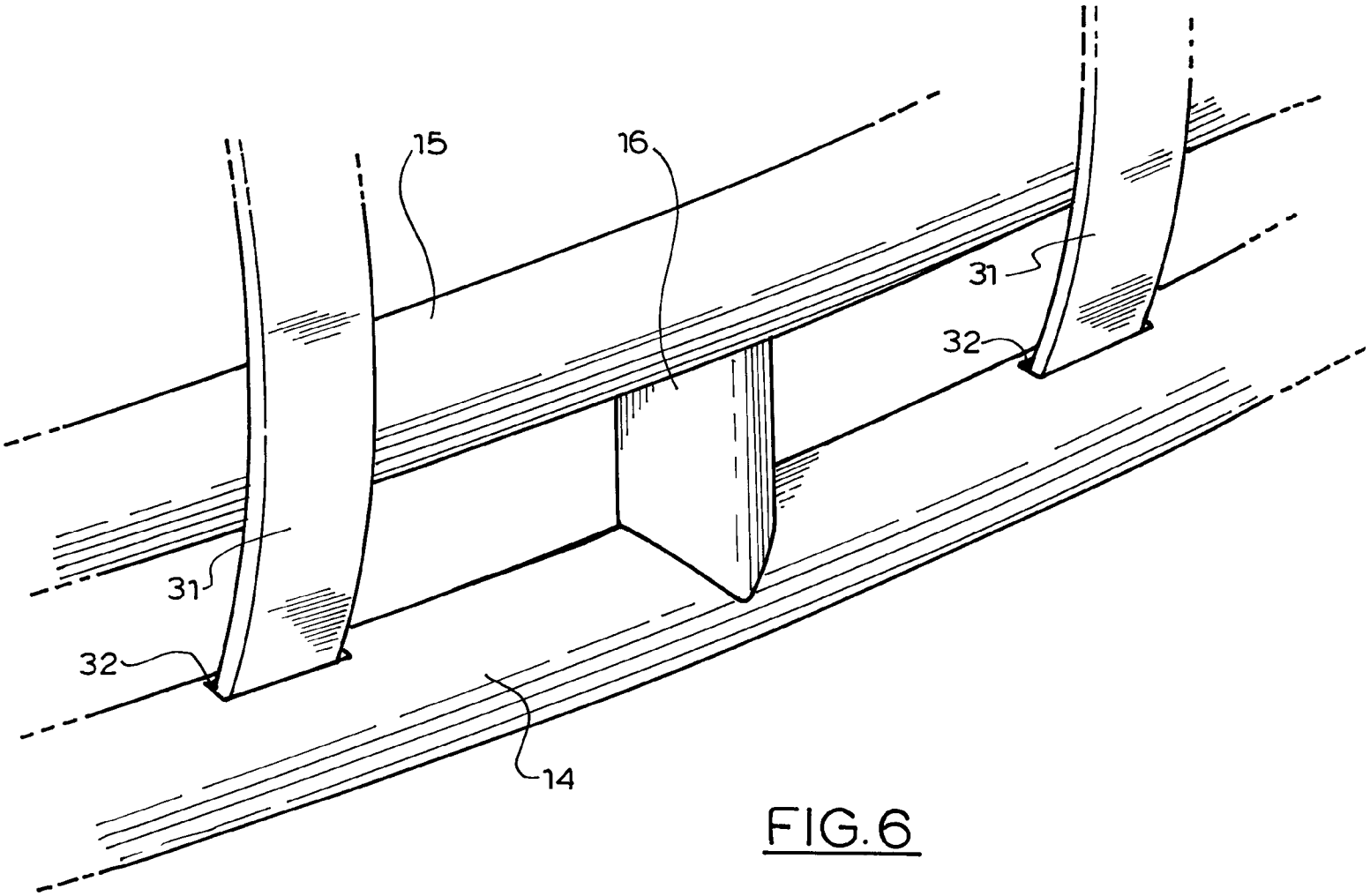
FIG. 6 is another enlarged pictorial representation of part of the trampoline of FIG. 1.
Figure 8:
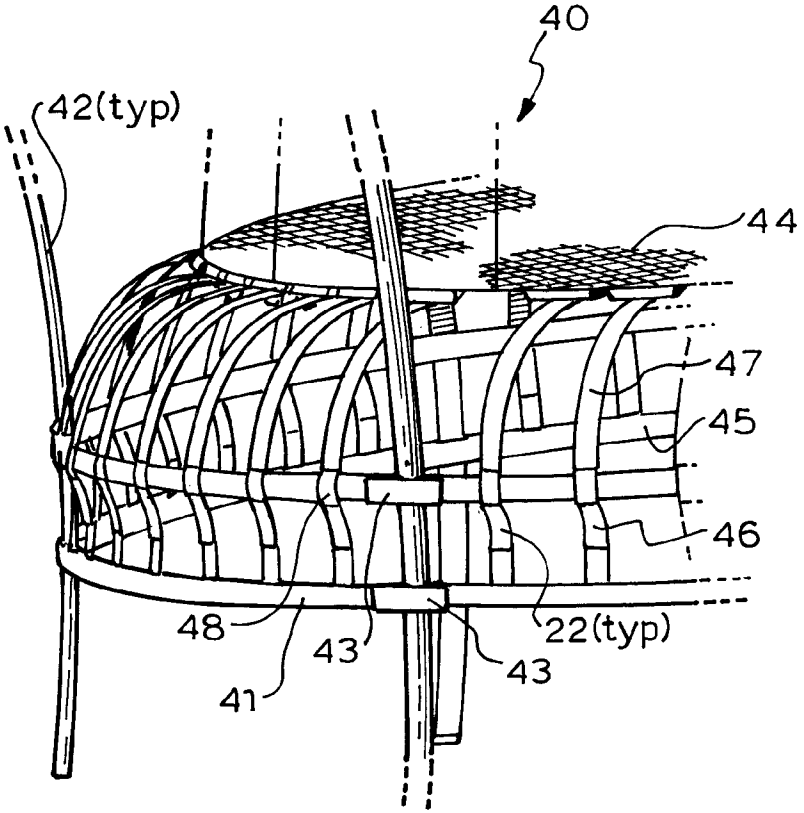
FIG. 8 is a detailed pictorial view showing part of the trampoline of FIG. 7.

The trampoline 10 illustrated in FIG. 1 includes an elevated circular frame 11 constructed of inter-connected arcuate frame segments 12 which are supported on seven angularly spaced legs 13. Each segment comprises spaced apart lower frame members 14 and upper frame members 15 formed of circular cross section steel tube which are permanently secured to each other by spaced apart connecting members or gussets 16 which are welded to each of the lower and upper frame members.

Each segment 12 is connected to the next angularly spaced segment 12 via opposed tubular leg mounts 21 which receive therein the end portions of the lower and upper frame members.

While the two frame members in the trampoline shown are circular in cross section, other cross sectional shapes are also satisfactory, for example, obround, oval, elliptical, etc.

Suitably, a jumping mat 24 is operatively connected to the frame 11 via a number of equi-angularly spaced resilient plates or leaf springs 31 which extend upwardly and curve inwardly from the frame.

The lower ends of the leaf springs 31 are fitted in respective slots 32 in the lower frame member 14 and generally parallel to the curved longitudinal axis of the lower frame member and the mat 24 is connected at its periphery to the leaf springs 31 adjacent their upper ends by connector assemblies and hooks similar to those described and illustrated in the first and second PCT applications.

A safety net 51 extends fully about the mat 24 as can be seen in FIG. 1 and is supported by angularly spaced posts 54 which are mounted to the respective legs 13. The posts 54 are formed of steel tube having the same cross sectional shape as the legs and are connected to their upper ends in a spigot and socket arrangement.

The combination of the lower frame member 14 and the upper frame member 15 being secured to each other as a unit or segment 12 provides for easy assembly of a trampoline frame with the spigot and socket fittings 21 on the posts being welded thereto so that when the segments 12 are connected to the posts during assembly it automatically results in the lower and upper frame members being in the correct relationship.

Further, the spacing between the lower and upper frame members allows shorter leaf springs to be used to achieve the desired bounce and also allows leaf springs with a single leaf to be used to achieve the desired bounce thereby reducing manufacturing costs.

The trampoline 40 illustrated in FIGS. 7 to 10 includes a circular bottom frame member 41 constructed of round steel tube which is supported above a support surface on seven angularly support poles shown typically at 42 each of which is connected to the frame member by a connection member 43. Suitably, a jumping mat 44 is operatively connected to the upper ends of forty-nine equally angularly and circumferentially spaced leaf springs shown typically at 22 which extend upwardly from the bottom frame member.

An upper circular frame member 45, also constructed of round steel tube, is supported by the support poles above the bottom frame member by the same for, of connection member 43. The leaf plates fit into spaced apart slots 23 respectively which are formed in the bottom frame member and run substantially parallel to the curved longitudinal axis of the frame member. The leaf springs are secured therein by virtue of frictional engagement provided by the tensioning of the leaf springs when connected to the mat. The leaf springs are curved in opposite directions along their length. Each spring plate has a lower portion 46 which proceeds upward and outward to the level of the upper circular frame member, and then to an upper portion 47 which proceeds upward and inward. At the transition between the upper and lower portions, a knuckle portion 48 is provided to engage the upper circular frame member. The double curvature of the resilient plates or leaf springs has been found surprisingly to provide a superior bounce quality to the mat in use.

Figure 10:
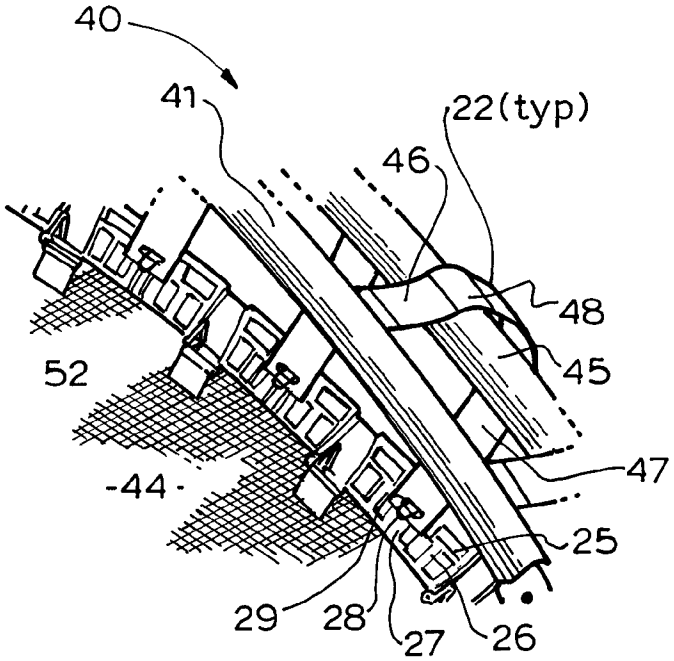
FIG. 10 is a detailed pictorial view from the underside showing part of the trampoline of FIG. 7
Figure 9:
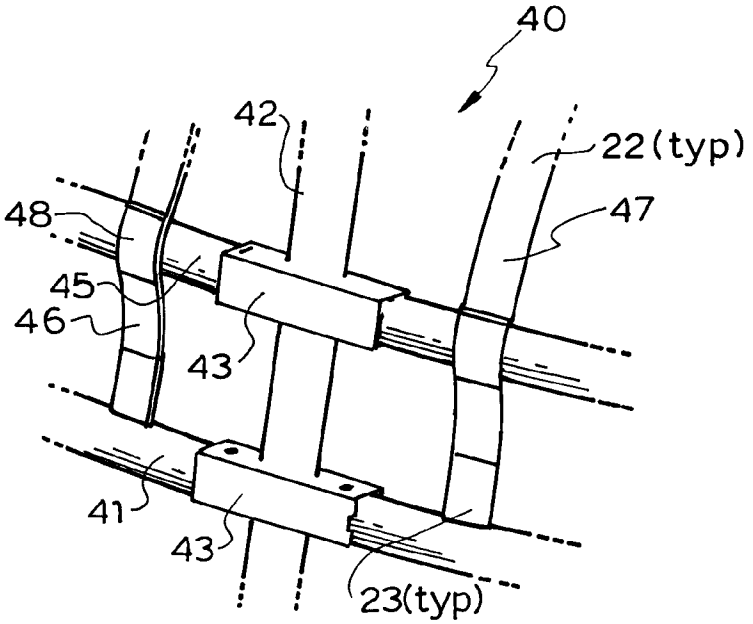
FIG. 9 is a more detailed pictorial view showing part of the trampoline of FIG. 7.

The mat is connected at its periphery to the leaf springs adjacent their upper ends by connector assemblies 25 as can be seen more clearly in FIG. 10. Each connector assembly comprises a load bearing connector block 26 and a hook 27. The connector blocks are adapted to engage in circumferential pockets formed at the periphery of the mat in a manner suitable for carrying the tensile load of the stretched mat. The hook 27 is a twin ended loop hook with the free ends both hooking to the connector block and the loop 28 hooking to the leaf spring in side by side relation through a holes 29 in the leaf spring as can be seen more clearly in FIG. 10.

Figure 7:
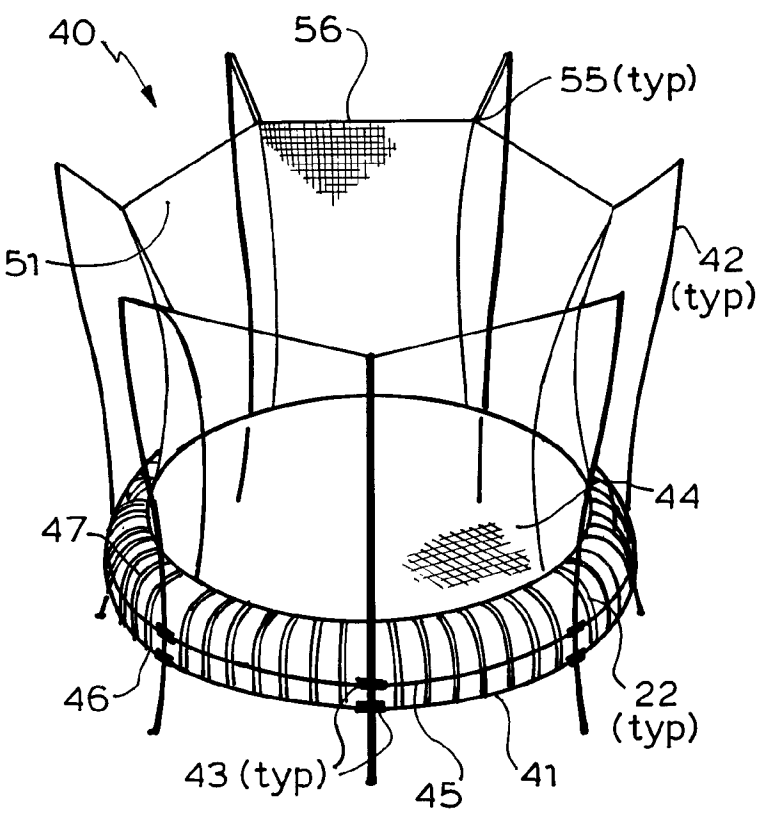
FIG. 7 is a pictorial view of a trampoline according to the invention.

A safety net 51 extends fully about the mat as can be seen in FIG. 7 and is secured to the mat at its lower edge 52 by circumferentially spaced "D" hooks. The net is connected along its upper edge 56 at seven connection points 55 and is supported by the seven spaced apart support posts.

Figure 12:
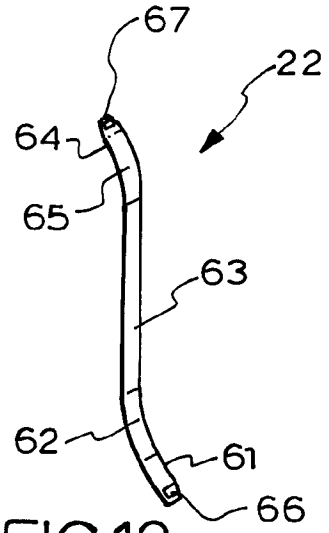
FIG. 12 is a pictorial view of the leaf spring of FIG. 11 of different weight.
Figure 11:
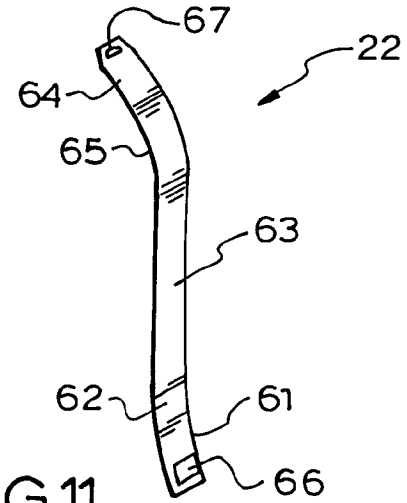
FIG. 11 is a pictorial view of a prebent leaf spring for a trampoline according to the invention.

The leaf spring illustrated in FIGS. 11 and 12 has a lower portion 61 having a lower curve 62 concave to the right in the orientation shown, an intermediate portion 63 which is substantially straight extending upward therefrom and an upper portion 64 having an upper curve 65 convex to the right. The leaf spring has a lower aperture 66 of rectangular form, the lower end of the leaf spring being substantially square, whereas the upper end has an upper aperture 67 of obround form, the upper end being tapered at 68. The leaf spring illustrated in FIG. 12 is more suited to trampolines of lighter construction.

Figure 14:
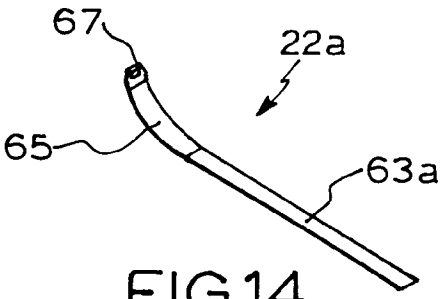
FIG. 14 is a pictorial view of the alternative leaf spring of FIG. 13 for a different application.
Figure 13:
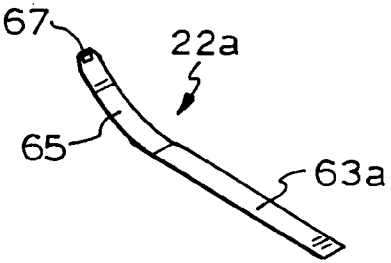
FIG. 13 is a pictorial view of an alternative leaf spring for a trampoline according to the invention.

The alternative leaf spring illustrated in FIGS. 13 and 14 is also prebent, but has only one curve towards the upper, tapered end. The same reference numerals are used for the same elements of the alternative leaf springs as those used in describing the leaf springs of FIGS. 11 and 12, the intermediate portion being a straight portion 63*a*. This form of alternative leaf spring is particularly suited to trampolines having a continuous mat. The alternative leaf spring illustrated in FIG. 13 is more suited to trampolines in a trampoline park orientated to form a trampoline wall, whereas the alternative leaf spring illustrated in FIG. 14 is more suited to the periphery of a continuous trampoline mat forming the floor of a trampoline park.

The trampoline according to the invention may be provided in knock-down or kit form suitable for a consumer to transport home from a retailer and assemble according to instructions provided in the kit. The leaf springs or resilient plates are relatively light weight, but being shorter and being provided in a more closely packed spacing, together with the double or compound curvature, provide superior bounce for a lighter weight trampoline which also has a lower material cost. When bouncing on the mat, the upper portions of the resilient plates bend downwards at the top and may also be displaced inwards slightly. However, the lower portions of the resilient plates are displaced generally outwardly with the downward displacement of the upper ends and of the resilient plates. Each portion of the resilient plates has a somewhat different spring constant by virtue of the length and curvature thereof.

The foregoing description has been given by way of illustrative example of the invention and many modifications and variations which will be apparent to persons skilled in the art may be made without departing from the spirit and scope of the invention as hereinbefore described and defined by the following claims.

The invention claimed is:

1. A trampoline including:

a frame including a plurality of frame segments or units connected together, each segment including lower and upper frame members secured together in spaced apart relationship for assembly with other segments or units;

a plurality of spaced apart flexible and resilient plates connected to the lower frame member of each segment or unit and extending upwards therefrom and engaged with said upper frame member, wherein each flexible and resilient plate has a lower portion curved in one direction and an upper portion curved in the opposite direction;

a jumping mat extending between said spaced apart flexible and resilient plates and being operatively connected at or adjacent its periphery thereto, said plates engaging the upper frame member of each segment or unit respectively above the lower frame member of the respective segment, wherein each of said resilient plates engage with said upper frame member at a transition between said lower portion of each of said resilient plates and said upper portion of each of said resilient plates and being arranged for movement inwards and outwards and/or up and down in response to a user jumping on said mat.

2. The trampoline according to claim 1, and including legs arranged to support the frame above the ground or other foundation, the legs including connectors for connecting frame segments thereto with one frame segment extending in one direction and one frame segment extending in the generally opposite direction so that the two segments form a continuous frame wherein a plurality of frame segments are connected with legs including connectors to provide a frame comprising adjacent legs positioned between adjacent frame segments.

3. The trampoline according to claim 2, wherein the frame segments are formed from round tube and the connectors are spigots adapted to fit firmly in the hollows of the frame segments or sockets adapted to receive firmly therein the end portions of the frame segments.

4. The trampoline according to claim 2, wherein the legs extend as posts upwards beyond the mat to provide safety net support poles for supporting a safety net about the mat.

5. The trampoline according to claim 1, wherein the upper frame members engage the plates against their respective inner faces allowing the plates to freely move against the outer face thereof so as to provide a fulcrum about which each plate may pivot at least to a small extent upon placing a load on the mat while at the same time preventing or at least inhibiting lateral movement of the plates towards the opposite side of the mat at the region of engagement of the mat with the plates.

6. The trampoline according to claim 5, wherein said trampoline is configured to prevent-sliding movement of each plate along the upper frame member in either a circumferential direction around the mat or a longitudinal direction along the plate.

7. The trampoline according claim 1, wherein the mat is connected to the flexible and resilient plates adjacent their upper ends by connector assemblies incorporating a hook and a load bearing fitting mounted in a pocket formed in the mat adjacent its periphery.

8. The trampoline according to claim 7, wherein the hook is connected at one end to the mat via the load bearing fitting and to the plates at the other end via one or more hook openings formed in the plate adjacent its upper end.

9. The trampoline according to claim 1, wherein the lower and upper frame members are permanently secured together by spacer members welded thereto.

10. The trampoline according to claim 1 wherein said spaced apart flexible and resilient plates are connected to said lower frame member by locating in spaced apart slots formed in said lower frame member, the slots being suitably sized to form a tight fit about the plates.

11. The trampoline according to claim 1, wherein the upper and lower frame members are secured together such that when fitted to each other for supporting the mat via the plates, the perimeter of the upper frame member is slightly less than the perimeter of the lower frame member.

12. The trampoline according to claim 1, wherein the frame comprises arcuate segments of round tube which are joined together in a spigot and socket arrangement with the end portion of one segment sliding into the end portion of the adjacent segment, wherein the frame segments are keyed together against relative rotational movement with respect to one another.

13. A trampoline including:

a frame adapted to rest on the ground or be mounted on a plurality of spaced apart legs, said frame including a bottom frame member and an upper frame member, said frame defining a space;

a plurality of spaced apart flexible and resilient plates extending upwards from said bottom frame member, each of said flexible and resilient plates having an upper end and a lower end and being connected to said bottom frame member at or adjacent their respective lower ends against relative movement between each flexible and resilient plate and said frame; and a jumping mat extending over said space defined by said frame between said opposed flexible and resilient plates and being operatively connected at or adjacent its periphery to said flexible and resilient plates at or adjacent their upper ends for movement with said flexible and resilient plates upon a person jumping on said mat; and wherein each flexible and resilient plate has a lower portion curved in one direction and an upper portion curved in the opposite direction, wherein each of said resilient plates engage with said upper frame member at a transition between said lower portion of each of said resilient plate and said upper portion of each of said resilient plates.

14. The trampoline according to claim 13, wherein the frame includes a plurality of frame segments or units connected together, each segment including lower and upper frame members secured together in spaced apart relationship for assembly with other segments or units.

15. The trampoline according to claim 13, wherein the curvature of the lower portion is less in extent than the curvature of the upper portion.

16. The trampoline according claim 13, wherein the curvature of the upper portion of each resilient plate, when in a relaxed condition has a larger radius of curvature than that of the lower portion, but when strained by attaching the jumping mat thereto, the upper portion has a curvature much the same as the curvature of the lower portion.

17. The trampoline of claim 13, wherein said flexible and resilient plates comprise a knuckle at said junction between said lower portion of each of said resilient plates and said upper portion of each of said resilient plates, wherein said knuckle is configured to engage said upper frame member.

18. A trampoline including:

a frame adapted to rest on the ground or be mounted on a plurality of spaced apart legs, said frame including a bottom frame member defining a space;

a plurality of spaced apart flexible and resilient plates extending upwards from said frame, each of said flexible and resilient plates having an upper end and a lower end and being connected to said frame at or adjacent their respective lower ends against relative movement between each flexible and resilient plate and said frame; and a jumping mat extending over said space defined by said frame between said opposed flexible and resilient plates and being operatively connected at or adjacent its periphery to said flexible and resilient plates at or adjacent their upper ends for movement with said flexible and resilient plates upon a person jumping on said mat; and wherein each flexible and resilient plate has a lower portion curved in one direction and an upper portion curved in the opposite direction, wherein the curvature of the upper portion of each resilient plate, when in a relaxed condition has a larger radius of curvature than that of the lower portion, but when strained by attaching the jumping mat thereto, the upper portion has a curvature much the same as the curvature of the lower portion.

* * * * *